US011107393B1

(12) United States Patent
Hsia et al.

(10) Patent No.: US 11,107,393 B1
(45) Date of Patent: Aug. 31, 2021

(54) LED PANEL CONTROLLING METHOD AND LED PANEL CONTROLLING SYSTEM

(71) Applicant: NATIONAL YUNLIN UNIVERSITY OF SCIENCE AND TECHNOLOGY, Yunlin County (TW)

(72) Inventors: Shih-Chang Hsia, Yunlin (TW); Wei-Chun Hung, Yunlin (TW)

(73) Assignee: NATIONAL YUNLIN UNIVERSITY OF SCIENCE AND TECHNOLOGY, Yunlin County (TW)

( * ) Notice: Subject to any disclaimer, the term of this patent is extended or adjusted under 35 U.S.C. 154(b) by 0 days.

(21) Appl. No.: 17/006,921

(22) Filed: Aug. 31, 2020

(51) Int. Cl.
*G09G 3/32* (2016.01)

(52) U.S. Cl.
CPC ..... *G09G 3/32* (2013.01); *G09G 2320/0276* (2013.01); *G09G 2320/0673* (2013.01); *G09G 2320/103* (2013.01); *G09G 2340/16* (2013.01); *G09G 2360/12* (2013.01); *G09G 2370/12* (2013.01)

(58) Field of Classification Search
CPC ..... G09G 3/32; G09G 2320/103; G09G 2320/0276; G09G 2320/0673; G09G 2370/12; G09G 2360/12; G09G 2340/16
See application file for complete search history.

(56) References Cited

U.S. PATENT DOCUMENTS

| | | | | |
|---|---|---|---|---|
| 9,583,068 | B2 * | 2/2017 | Nobori | G09G 3/002 |
| 2004/0119730 | A1 * | 6/2004 | Ham | G09G 3/3648 345/692 |
| 2007/0063954 | A1 * | 3/2007 | Huang | G09G 3/2092 345/98 |
| 2010/0007597 | A1 * | 1/2010 | Lee | G09G 3/36 345/99 |
| 2011/0242088 | A1 * | 10/2011 | Kim | G09G 3/3685 345/214 |

* cited by examiner

*Primary Examiner* — Brent D Castiaux
(74) *Attorney, Agent, or Firm* — CKC & Partners Co., LLC

(57) ABSTRACT

An LED panel controlling method is applied to control an LED panel and includes a frame splitting step, a comparing and transmitting step, a laminating step and a controlling step. In the comparing and transmitting step, a plurality of previous datasets of the previous frame are stored in a transmitting module before a plurality of current datasets of the current frames are transmitted to and stored in the transmitting module, and the current datasets are compared to the previous datasets. In the laminating step, the current datasets are laminated with the previous datasets previously stored in the receiving module to form a controlling sequence. In the controlling step, the controlling sequence is received by a driving module to drive the LED row.

6 Claims, 9 Drawing Sheets

100

500

LED PANEL CONTROLLING METHOD AND LED PANEL CONTROLLING SYSTEM

BACKGROUND

Technical Field

The present disclosure relates to a controlling method and a controlling system. More particularly, the present disclosure relates to an LED panel controlling method and an LED panel controlling system.

Description of Related Art

Recently, owing to the fast development of LED technology, the applications of LED develop to large displaying systems. In LED display, the color retention and consistency are more difficult than other flat panels such as LCD displays. The LED switching time is nanocurrents. While coupling with its large display area with long-distance wires for signal transmission, the data transmission is bounded by the operating frequency and the wiring length. However, the frequency must be promoted for huge data transferring in a high resolution display. Hence, the stability of the system becomes low. In addition, the high frequency switching will consume more energy.

In order to solve this problem, a parallel structure is used to reduce the frequency; however, in the parallel structure, the number of wiring increases, and the implementation cost and system complex become high. Hence, there is a need to improve the controlling method and system to solve the problems.

SUMMARY

According to one aspect of the present disclosure, an LED panel controlling method is applied to control an LED panel including (1,1) to (N,M) LED areas to display a previous frame and a current frame displayed subsequently to the previous frame. Each of the (1,1) to (N,M) LED areas includes (1,1) to (H,1) LED rows, and each of the (1,1) to (H,1) LED rows includes (1,1) to (1,D) LED pixels. The LED panel controlling method includes a frame splitting step, a comparing and transmitting step, a laminating step and a controlling step. In the frame splitting step, each of the previous frame and the current frame is split into (1,1) to (N,M) areas, and each of the (1,1) to (N,M) areas includes (1,1) to (G,K) blocks. Each of the (1,1) to (G,K) blocks includes (1,1) to (P,1) rows, and each of the (1,1) to (P,1) rows includes (1,1) to (1,E) pixels, where N, M, H, D, G, K, P and E are positive integers, G×P=H, and K×E=D. In the comparing and transmitting step, a plurality of previous datasets of the previous frame are stored in a transmitting module before a plurality of current datasets of the current frames are transmitted to and stored in the transmitting module, and the current datasets are compared to the previous datasets. Whether the current dataset of the (1,e) pixel of the (p,1) row of the (g,k) block of the (n,m) area is different from the previous dataset of the (1,e) pixel of the (p,1) row of the (g,k) block of the (n,m) area is judged, and, if yes, an area address of the (n,m) area, a block address of the (g,k) block, a row address of the (p,1) row, and the current datasets of the (1,1) to (1,E) pixels of the (p,1) row of the (g,k) block of the (n,m) area are coded and transmitted to a receiving module, where each of e, p, g, k, n and m represents a variable, e is a positive integer between 1 to E inclusive, p is a positive integer between 1 to P inclusive, g is a positive integer between 1 to G inclusive, k is a positive integer between 1 to K inclusive, n is a positive integer between 1 to N inclusive, and m is a positive integer between 1 to M inclusive. As long as the current datasets of the (g,k) block of the (n,m) area are identical to the previous datasets of the (g,k) block of the (n,m) area, the current datasets of the (g,k) block of the (n,m) area are not coded and transmitted. In the laminating step, the current datasets of the (p,1) row of one or more of the (g,1) to (g,K) blocks of the (n,m) area newly received by the receiving module are laminated with the previous datasets of the (p,1) row of the rest of the (g,1) to (g,K) blocks of the (n,m) area previously stored in the receiving module to form a (n,m)_((g-1)×P+p,1) controlling sequence. In the controlling step, the (n,m)_((g-1)×P+p,1) controlling sequence is received by a driving module to drive the ((g-1)×P+p,1) LED row of the (n,m) LED area.

According to another aspect of the present disclosure, an LED panel controlling system includes an LED panel configured to display a previous frame and a current frame displayed subsequently to the previous frame, a frame source module configured to providing the previous frame and the current frame, a transmitting module configured to receive the previous frame and the current frame, a receiving module and a driving module. The LED panel includes (1,1) to (N,M) LED areas, and each of the (1,1) to (N,M) LED areas includes (1,1) to (H,1) LED rows. Each of the (1,1) to (H,1) LED rows includes (1,1) to (1,D) LED pixels, where N, M, H and D are positive integers. Each of the previous frame and the current frame is split into (1,1) to (N,M) areas, and each of the (1,1) to (N,M) areas includes (1,1) to (G,K) blocks. Each of the (1,1) to (G,K) blocks includes (1,1) to (P,1) rows, and each of the (1,1) to (P,1) rows includes (1,1) to (1,E) pixels, where D, G, K, P and E are positive integers, G×P=H, and K×E=D. The transmitting module includes a first memorizing set configured to store a plurality of previous datasets of the previous frame, a second memorizing set configured to store a plurality of current datasets of the current frame, a comparing module configured to compare the current datasets and the previous datasets, and a coding and transmitting set. When the current dataset of the (1,e) pixel of the (p,1) row of the (g,k) block of the (n,m) area is different from the previous dataset of the (1,e) pixel of the (p,1) row of the (g,k) block of the (n,m) area, an area address of the (n,m) area, a block address of the (g,k) block, a row address of the (p,1) row, and the current datasets of the (1,1) to (1,E) pixels of the (p,1) row of the (g,k) block of the (n,m) area are coded and transmitted by the coding and transmitting set, where each of e, p, g, k, n and m represents a variable, e is a positive integer between 1 to E inclusive, p is a positive integer between 1 to P inclusive, g is a positive integer between 1 to G inclusive, k is a positive integer between 1 to K inclusive, n is a positive integer between 1 to N inclusive, and m is a positive integer between 1 to M inclusive. As long as the current datasets of the (g,k) block of the (n,m) area are identical to the previous datasets of the (g,k) block of the (n,m) area, the current datasets of the (g,k) block of the (n,m) area are not coded and transmitted. The receiving module is configured to laminate the current datasets of the (p,1) row of one or more of the (g,1) to (g,K) blocks of the (n,m) area newly received by the receiving module with the previous datasets of the (p,1) row of the rest of the (g,1) to (g,K) blocks of the (n,m) area previously stored in the receiving module to form a (n,m)_((g-1)×P+p,1) controlling sequence. The driving module includes (1,1) to (N,M) LED controlling sets to control the (1,1) to (N,M) LED areas, respectively, and the ((g-1)×P+p,1) LED row of the (n,m) LED area is driven by the (n,m) LED controlling set according to the (n,m)_((g-1)×P+p,1) controlling sequence.

BRIEF DESCRIPTION OF THE DRAWINGS

The present disclosure can be more fully understood by reading the following detailed description of the embodiments, with reference made to the accompanying drawings as follows.

DETAILED DESCRIPTION

Figure 1:
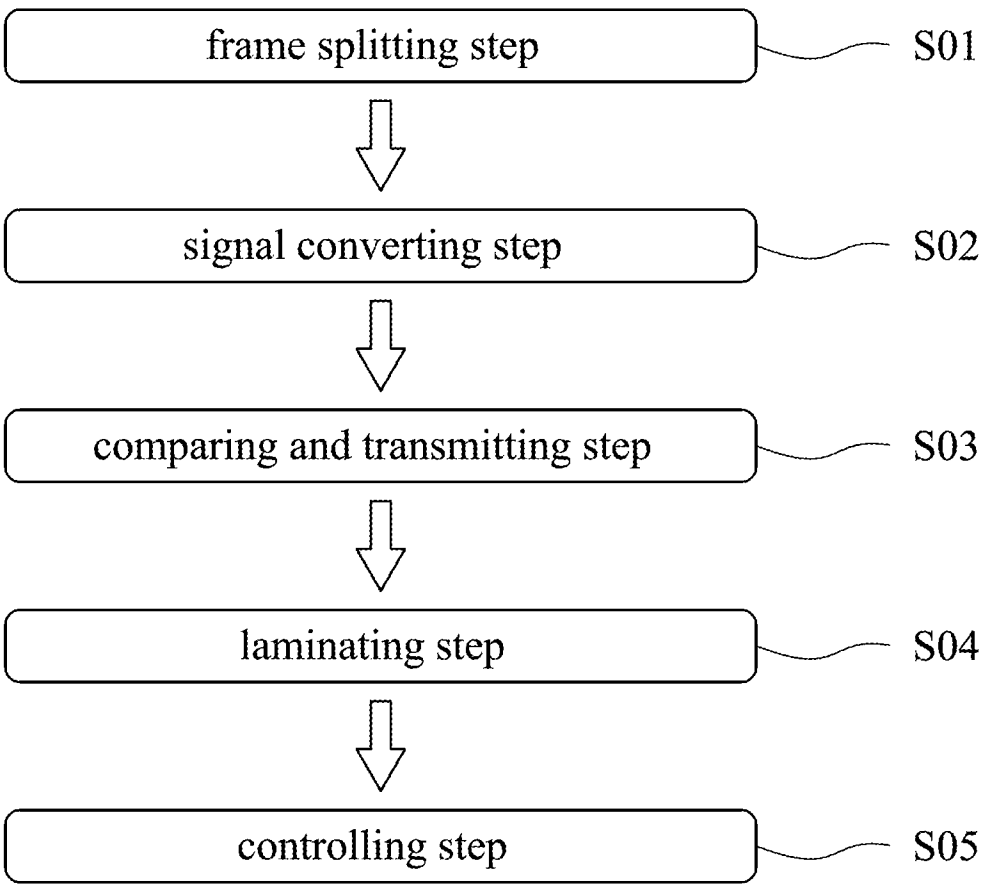
FIG. 1 shows a flow chart of the LED panel controlling method according to one embodiment of the present disclosure.
Figure 2:
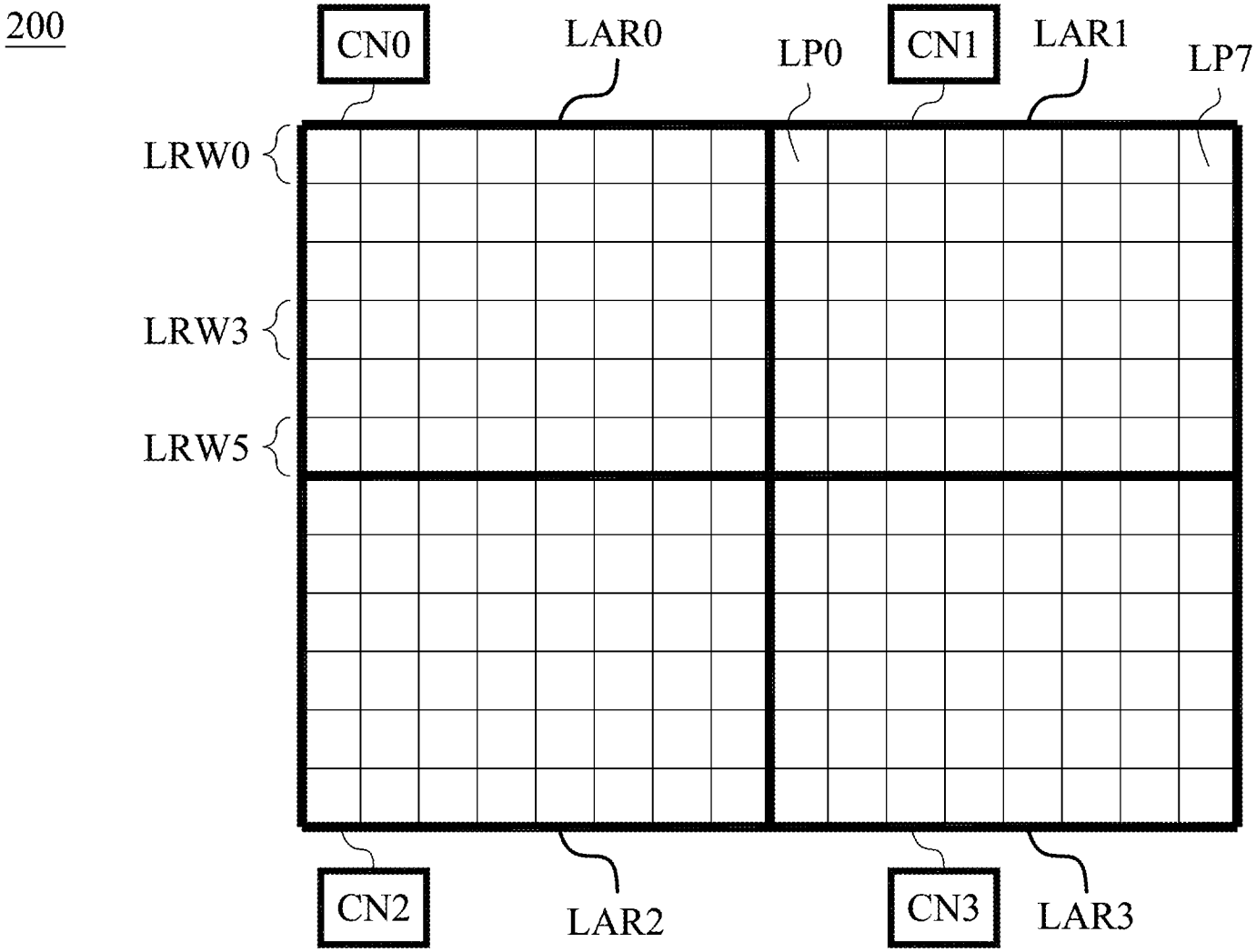
FIG. 2 shows an illustration of the LED panel applied to the LED panel controlling method of FIG. 1.
Figure 3:
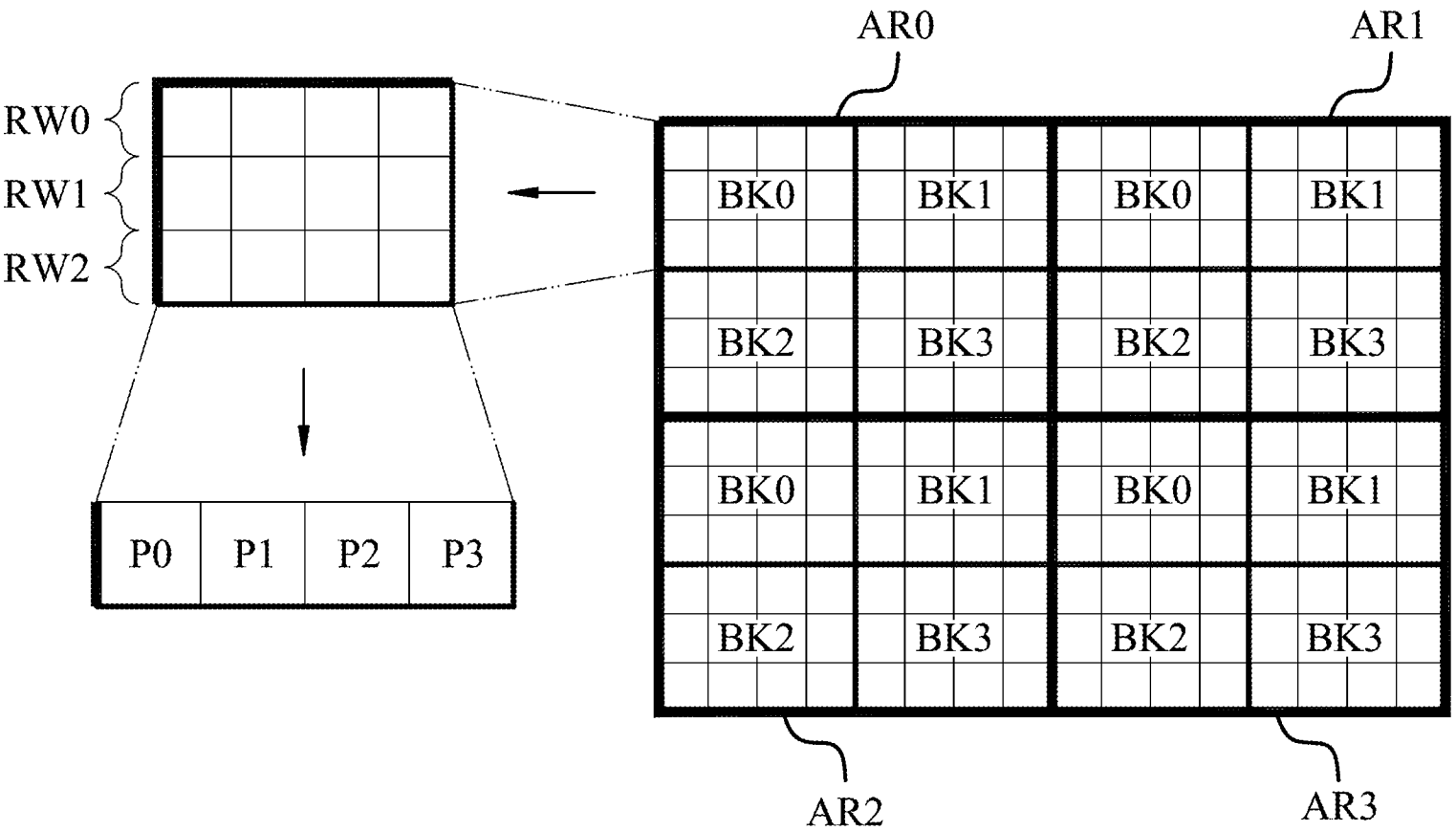
FIG. 3 shows an illustration of a previous frame applied to the LED panel controlling method of FIG. 1.
Figure 4:
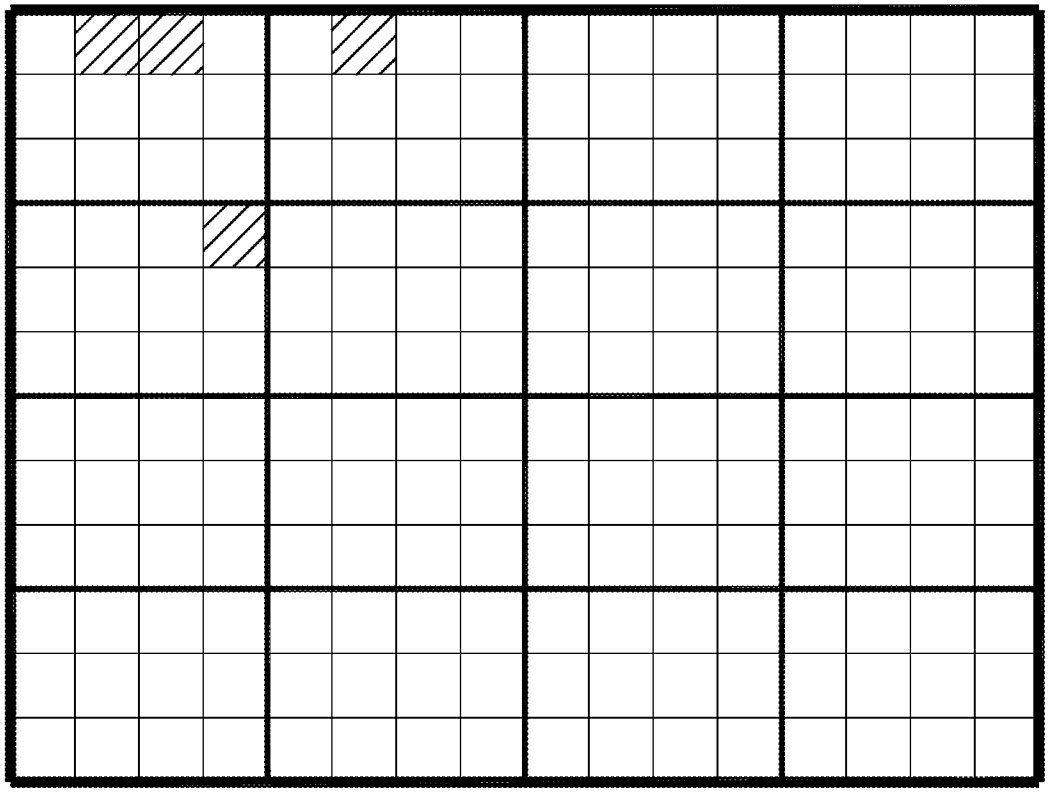
FIG. 4 shows an illustration of a current frame applied to the LED panel controlling method of FIG. 1.

FIG. 1 shows a flow chart of the LED panel controlling method 100 according to one embodiment of the present disclosure. FIG. 2 shows an illustration of the LED panel 200 applied to the LED panel controlling method 100 of FIG. 1. FIG. 3 shows an illustration of a previous frame applied to the LED panel controlling method 100 of FIG. 1. FIG. 4 shows an illustration of a current frame applied to the LED panel controlling method 100 of FIG. 1. The LED panel controlling method 100 is applied to control the LED panel 200 including (1,1) to (N,M) LED areas to display a previous frame and a current frame displayed subsequently to the previous frame. Each of the (1,1) to (N,M) LED areas includes (1,1) to (H,1) LED rows, and each of the (1,1) to (H,1) LED rows includes (1,1) to (1,D) LED pixels. As shown in FIG. 2, N is 2 and M is 2; hence, the LED panel 200 includes the (1,1) LED area LAR0, the (1,2) LED area LAR1, the (2,1) LED area LAR2 and the (2,2) LED area LAR3. H is 6, and, taking the (1,1) LED area LAR0 as an example, the (1,1) LED area LAR0 includes the (1,1) LED row LRW0 to the (6,1) LED row LRW5. D is 8, and, taking the (1,1) LED row LRW0 as an example, the (1,1) LED row LRW0 includes the (1,1) LED pixel LP0 to the (1,8) LED pixel LP7.

The LED panel controlling method 100 includes a frame splitting step S01, a comparing and transmitting step S03, a laminating step S04 and a controlling step S05.

In the frame splitting step S01, each of the previous frame and the current frame is split into (1,1) to (N,M) areas, and each of the (1,1) to (N,M) areas includes (1,1) to (G,K) blocks. Each of the (1,1) to (G,K) blocks includes (1,1) to (P,1) rows, and each of the (1,1) to (P,1) rows includes (1,1) to (1,E) pixels, where N, M, H, D, G, K, P and E are positive integers, G×P=H, and K×E=D. As shown in FIG. 3, N is 2 and M is 2; hence, each of the previous frame and the current frame includes the (1,1) area AR0, the (1,2) area AR1, the (2,1) area AR2 and the (2,2) area AR3. G is 2 and K is 2, and, taking the (1,1) area AR0 as an example, the (1,1) area AR0 includes the (1,1) block BK0, the (1,2) block BK1, the (2,1) block BK2 and the (2,2) block BK3. P is 3, and, taking the (1,1) block BK0 as an example, the (1,1) block BK0 includes the (1,1) row RW0, the (2,1) row RW1 and the (3,1) row RW2. E is 4, and, taking the (3,1) row RW2 as an example, the (3,1) row RW2 includes the (1,1) pixel P0, the (1,2) pixel P1, the (1,3) pixel P2 and the (1,4) pixel P3.

In the comparing and transmitting step S03, a plurality of previous datasets of the previous frame are stored in a transmitting module 520 (shown in FIG. 5) before a plurality of current datasets of the current frame are transmitted to and stored in the transmitting module 520, and the current datasets are compared to the previous datasets. Whether the current dataset of the (1,e) pixel of the (p,1) row of the (g,k) block of the (n,m) area is different from the previous dataset of the (1,e) pixel of the (p,1) row of the (g,k) block of the (n,m) area is judged, and, and if yes, an area address of the (n,m) area, a block address of the (g,k) block, a row address of the (p,1) row, and the current datasets of the (1,1) to (1,E) pixels of the (p,1) row of the (g,k) block of the (n,m) area are coded and transmitted to a receiving module 530, where each of e, p, g, k, n and m represents a variable, e is a positive integer between 1 to E inclusive, p is a positive integer between 1 to P inclusive, g is a positive integer between 1 to G inclusive, k is a positive integer between 1 to K inclusive, n is a positive integer between 1 to N inclusive, and m is a positive integer between 1 to M inclusive. As long as the current datasets of the (g,k) block of the (n,m) area are identical to the previous datasets of the (g,k) block of the (n,m) area, the current datasets of the (g,k) block of the (n,m) area are not coded and transmitted.

In the laminating step S04, the current datasets of the (p,1) row of one or more of the (g,1) to (g,K) blocks of the (n,m) area newly received by the receiving module 530 are laminated with the previous datasets of the (p,1) row of the rest of the (g,1) to (g,K) blocks of the (n,m) area previously stored in the receiving module 530 to form a (n,m)_((g-1)×P+p,1) controlling sequence.

In the controlling step S05, the (n,m)_((g-1)×P+p,1) controlling sequence is received by a driving module 540 (shown in FIG. 5) to drive the ((g-1)×P+p,1) LED row of the (n,m) LED area.

Figure 5:
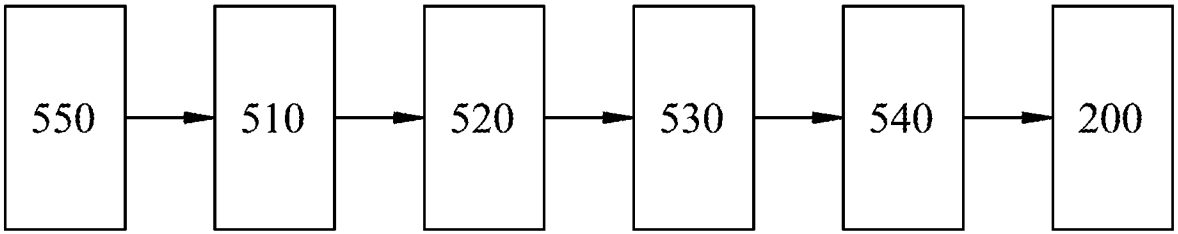
FIG. 5 shows a block diagram of an LED panel controlling system according to another embodiment of the present disclosure.
Figure 6:
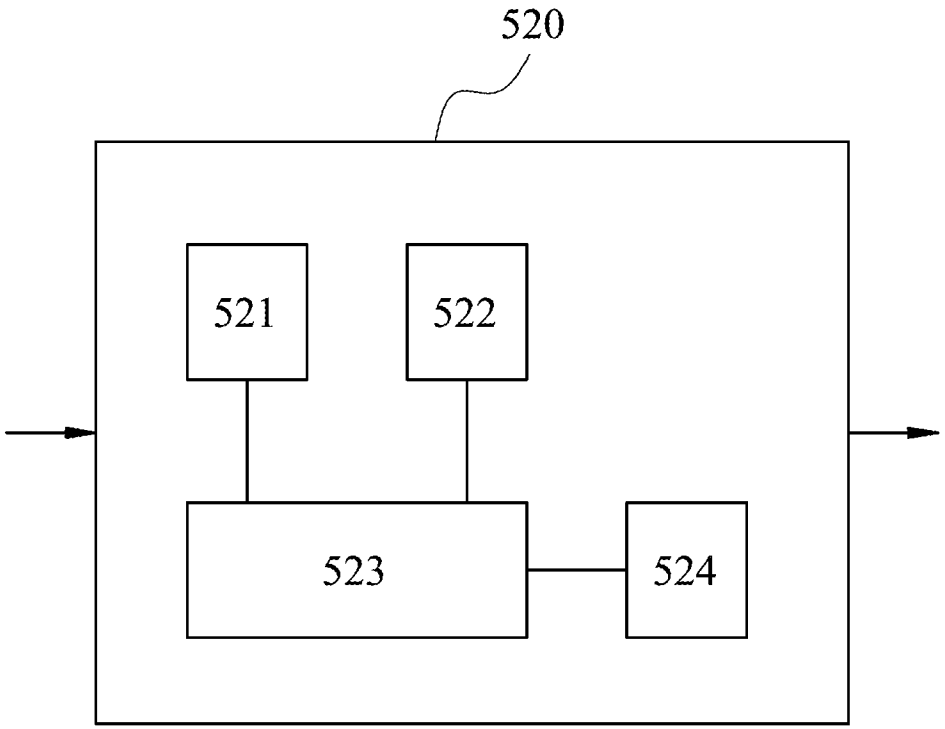
FIG. 6 shows a block diagram of the transmitting module of the LED panel controlling system of FIG. 5.
Figure 7:
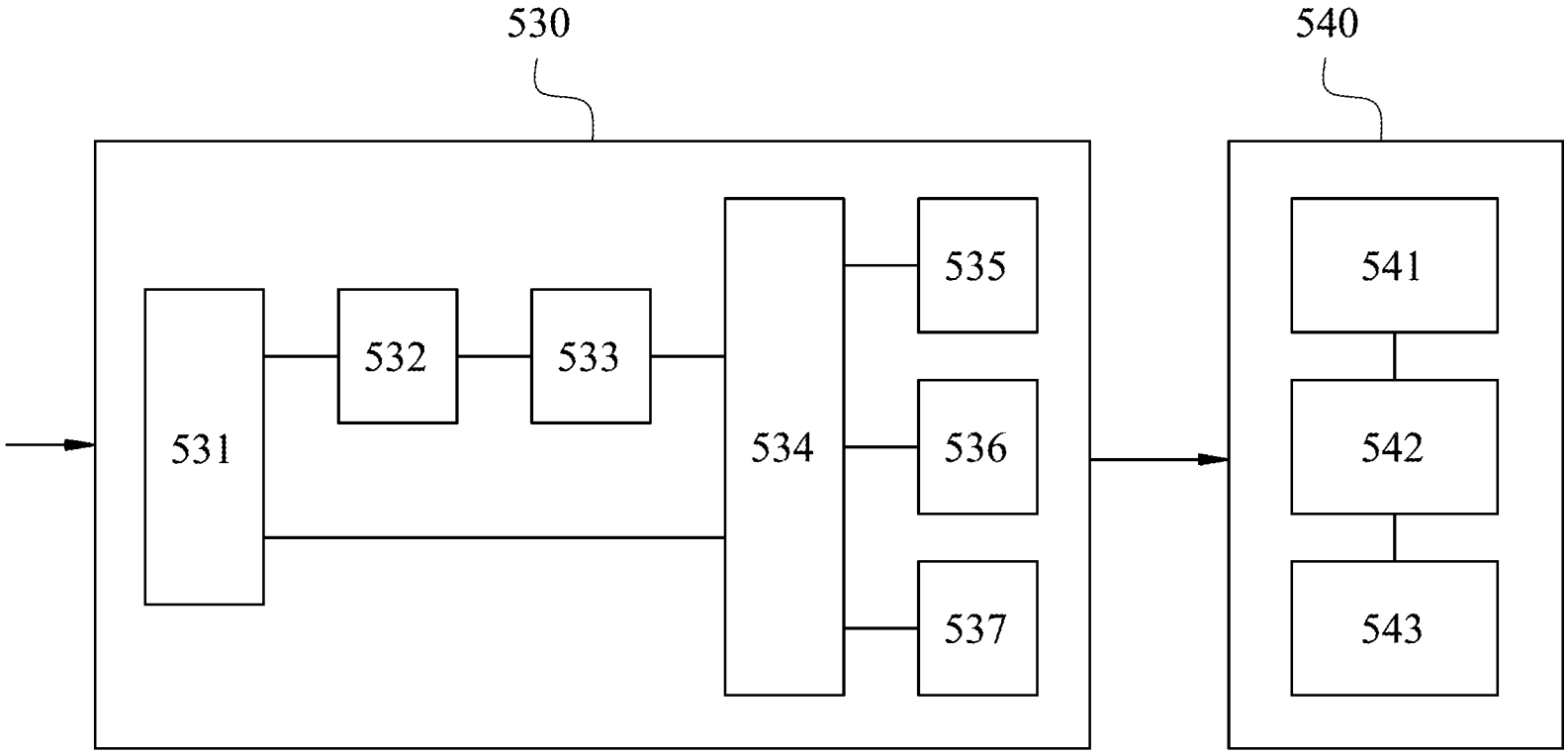
FIG. 7 shows a block diagram of the receiving module and the controlling module of the LED panel controlling system of FIG. 5.

FIG. 5 shows a block diagram of an LED panel controlling system 500 according to another embodiment of the present disclosure. FIG. 6 shows a block diagram of the transmitting module 520 of the LED panel controlling system 500 of FIG. 5. FIG. 7 shows a block diagram of the receiving module 530 and the controlling module 540 of the LED panel controlling system 500 of FIG. 5. The details of the LED panel controlling method 100 will be described with reference of the LED panel controlling system 500 shown in FIGS. 5 to 7 hereinafter.

The LED panel controlling system 500 can include a frame source module 550 configured to provide the previous frame and the current frame. The frame source module 550 can be, but not limited to, a computer or a camera. The LED panel controlling method 100 can further include a signal converting step S02, and a HDMI is converted to a DVI as transmitting the previous datasets of the previous frame or the current datasets of the current frame to the transmitting module 520. The LED panel controlling system 500 can include a signal converting module 510 signally connected to the frame source module 550 for converting the HDMI to the DVI. The signal converting module 510 can further be signally connected to the transmitting module 520, and, after signal converting, the signal converting module 510 can send a clock signal, an enable controlling signal, horizontal and vertical synchronous signals, and the data signal including the previous datasets or the current datasets to the transmitting module 520.

The transmitting module 520 can be a FPGA (field programming gate array) and include a first memorizing set 521 configured to store the previous datasets of the previous frame, a second memorizing set 522 configured to store the current datasets of the current frame, a comparing module 523 configured to compare the current datasets and the previous datasets, and a coding and transmitting set 524.

In the comparing and transmitting step S03, the current datasets are compared with the previous datasets row by row and block by block by the comparing module 523. The comparing module 523 can read the first datasets stored in the first memorizing set 521 and read the second datasets stored in the second memorizing set 522.

As shown in FIGS. 3 and 4, the current dataset of the (1,1) pixel P0 of the (1,1) row RW0 of the (1,1) block BK0 of the (1,1) area AR0 is compared to the previous dataset of the (1,1) pixel P0 of the (1,1) row RW0 of the (1,1) block BK0 of the (1,1) area AR0. Then, the current dataset of the (1,2) pixel P1 of the (1,1) row RW0 of the (1,1) block BK0 of the (1,1) area AR0 is compared to the previous dataset of the (1,2) pixel P1 of the (1,1) row RW0 of the (1,1) block BK0 of the (1,1) area AR0. The comparison will be continuous until the comparison of the last pixel, i.e., the (1,4) pixel P3 of the (3,1) row RW2 of the (2,2) block BK3 of the (2,2) area AR3, is done. And whether the current dataset is different from the previous dataset is recorded. After comparison between the current datasets and the previous datasets of the (1,1) pixel P0 to the (1,4) pixel P3 of the (1,1) row RW0 of the (1,1) block BK0 of the (1,1) area AR0 are completed, it is found that the current datasets of the (1,2) pixel P1 and the (1,3) pixel P3 of the (1,1) row RW0 of the (1,1) block BK0 of the (1,1) area AR0 are different from the previous datasets thereof. Hence, the current datasets thereof can be coded by the coding and transmitting set 524 with the area address of the (1,1) area AR0, the block address of the (1,1) block BK0 and the row address of the (1,1) row RW0.

Figure 8:
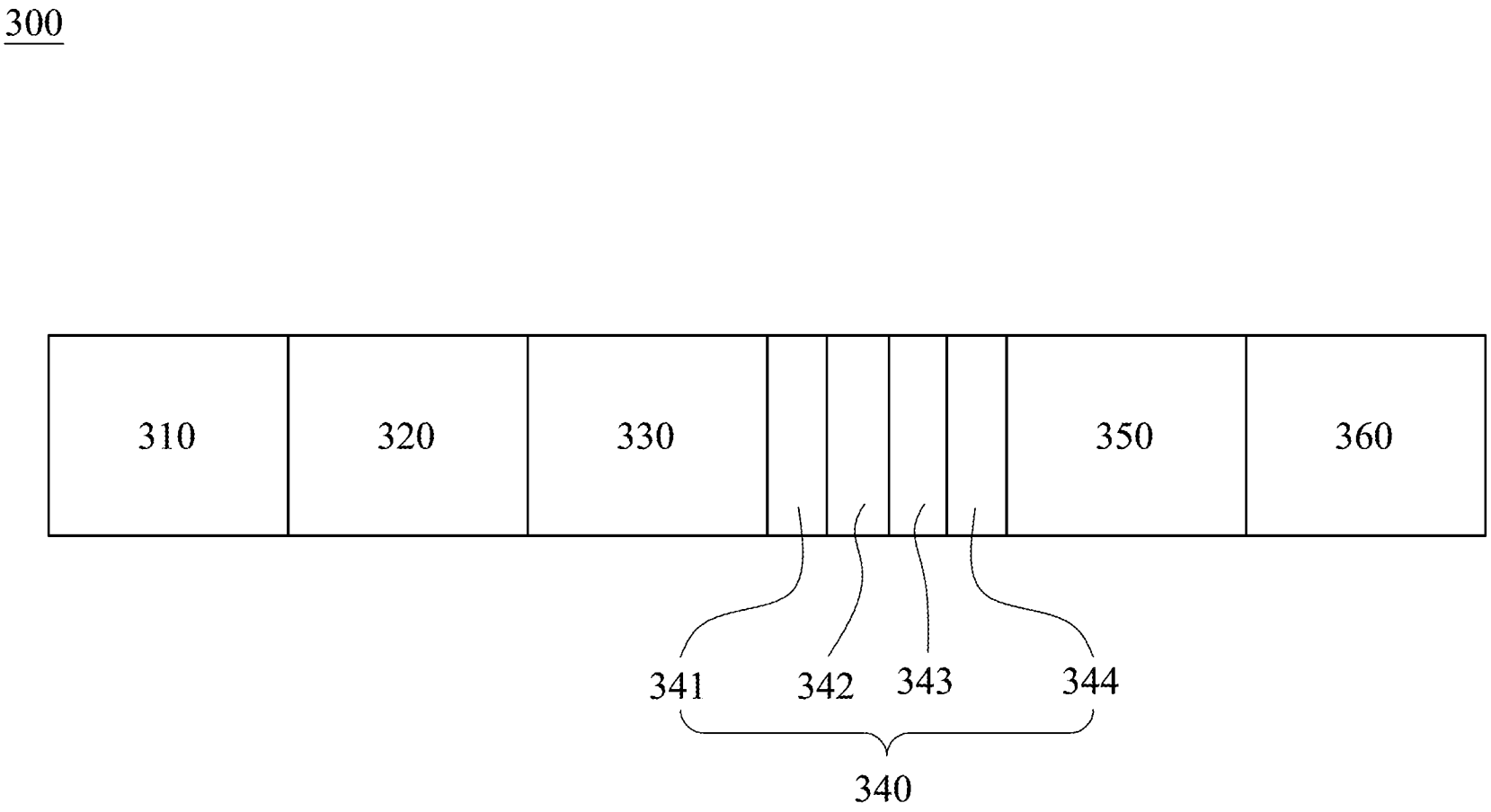
FIG. 8 shows an illustration of a code format coded by the transmitting module of the LED panel controlling system of FIG. 5.

FIG. 8 shows an illustration of a code format 300 coded by the transmitting module 520 of the LED panel controlling system 500 of FIG. 5. The code format 300 can include a position 310 for the area address of the (1,1) area AR0, a position 320 for the block address of the (1,1) block RW0, a position 330 for the row address of the (1,1) row RW0, and a position 340 for R-values of the current datasets of the (1,1) pixel P0 to the (1,4) pixel P3, a position 350 for G-values of the current datasets of the (1,1) pixel P0 to the (1,4) pixel P3, and a position 360 for B-values of the current datasets of the (1,1) pixel P0 to the (1,4) pixel P3. The position 340 includes columns 341 to 344 for the R-values of the current dataset of the (1,1) pixel P0 to the (1,4) pixel P3, respectively. The position 350 and the position 360 are similar to the position 340. The R-values of the current dataset of the (1,1) pixel P0 to the (1,4) pixel P3 can be connected by at least one line buffer (not shown) of the coding and transmitting set 524 first and then be coded by a SPI controller (not shown) of the coding and transmitting set 524.

Please go back to FIGS. 3 and 4, similarly, the area address of the (1,1) area AR0, the block address of the (1,2) block BK1, the row address of the (1,1) row RW0, and the current dataset of the (1,1) pixel P0 to the (1,4) pixel P3 thereof are coded. The area address of the (1,1) area AR0, the block address of the (2,1) block BK2, the row address of the (1,1) row RW0, and the current dataset of the (1,1) pixel P0 to the (1,4) pixel P3 thereof are coded.

The LED controlling system 500 further includes a receiving module 530 and the receiving module 530 includes an address reading set 531, a data reading set 532, a gamma correction set 533 and a data laminating set 534. In the recoding step S04, the R-value, the G-value and the B-value of each of the current datasets newly received by the receiving module 530 are gamma corrected, and an R-value, a G-value and a B-value of each of the previous datasets previously stored in the receiving module 530 have already been gamma corrected. To be more specific, after receiving the code format 300, the address reading set 531 can read the area address of the (1,1) area AR0, the block address of the (1,1) block BK0, and the row address of the (1,1) row RW0, and the data reading set 532 can read the R-values, the B-values and the G-values of the current datasets thereof. Each of the R-values, the B-values and the G-values may originally have 8-bit length, and after being gamma corrected by the gamma correction set 533, each of the R-values, the B-values and the G-values may extend to 12-bit length. Since the previous datasets have been already transmitted to the receiving module 530 before displaying of the previous frame on the LED panel 200, all of the previous datasets have been stored in the receiving module 530 and have been gamma corrected by the gamma correction set 533 before the current datasets for displaying the current frame is transmitted.

Figure 9:
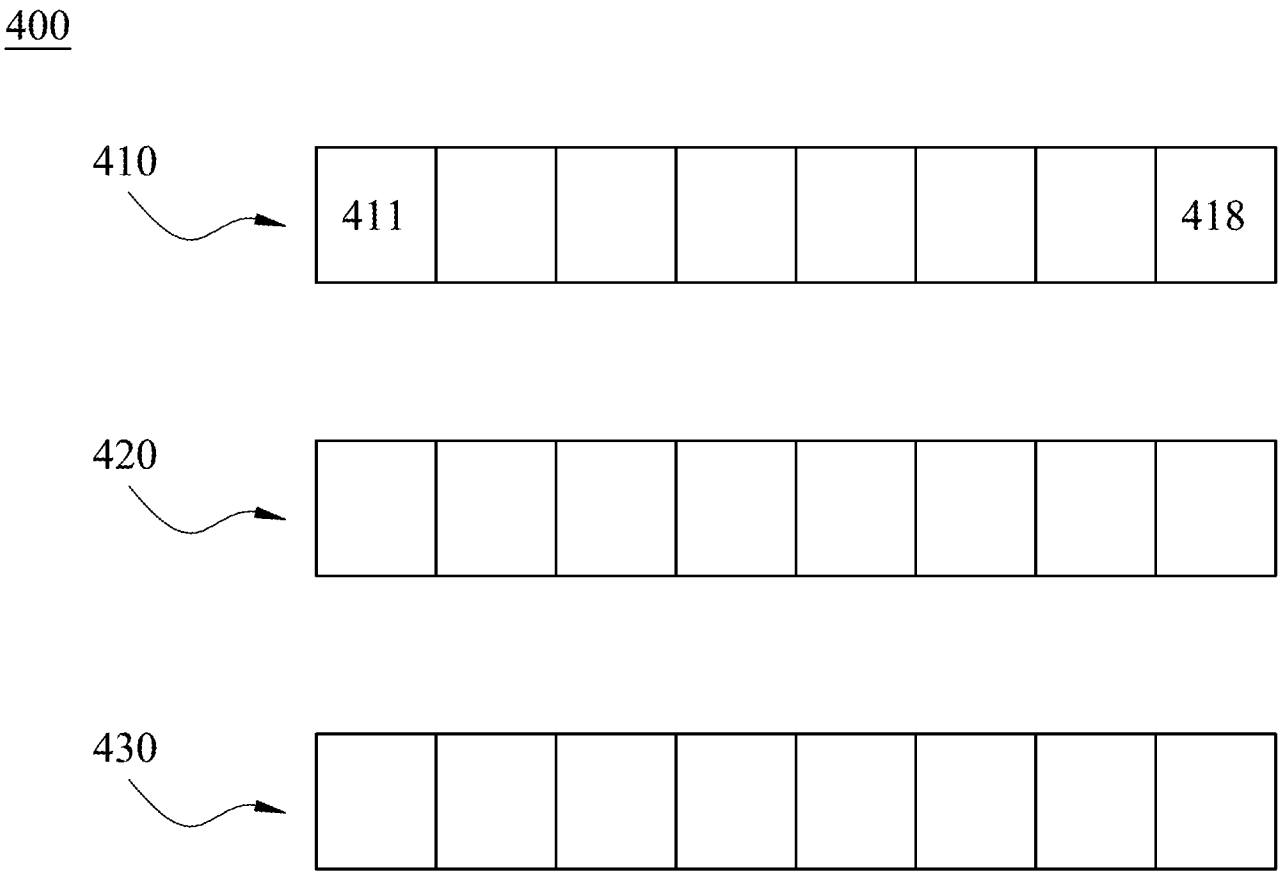
FIG. 9 shows an illustration of a controlling sequence laminated by the receiving module of the LED panel controlling system of FIG. 5.

FIG. 9 shows an illustration of a controlling sequence 400 laminated by the receiving module 530 of the LED panel controlling system 500 of FIG. 5. Please refer to FIG. 9 with reference of FIGS. 3 to 7, the area address of the one of the current datasets newly received is 0 which means the (1,1) area AR0. The block addresses of the current datasets newly received belonging to the (1,1) area AR0 are 0, 1 and 2 which mean the (1,1), (1,2) and (2,1) blocks BK0, BK1 and BK3, respectively. Because the (1,1) row RW0 of the (1,1) and (1,2) blocks BK0 and BK1 of the (1,1) area AR0 can be connected together to correspond to the (1,1) LED row LRW0 of the (1,1) LED area LAR0, the gamma-corrected R-value of the current datasets of the (1,1) pixel P0 to the (1,4) pixel P3 of the (1,1) row RW0 of the (1,1) block BK0 of the (1,1) area AR0 are laminated with the gamma-corrected R-value of the current datasets of the (1,1) pixel P0 to the (1,4) pixel P3 of the (1,1) row RW0 of the (1,2) block BK1 of the (1,1) area AR0 as the controlling sequence 400, e.g., a (1,1)_(1,1) controlling sequence 400 for controlling the (1,1) LED row LRW0 of the (1,1) LED area LAR0 by the data laminating set 534. The controlling sequence 400 can include sub-sequences 410 to 430. The sub-sequence 410 has positions 411 to 418 for the gamma corrected R-values arranged in sequence: R-value of the (1,1) pixel P0 of the (1,1) row RW0 of the (1,1) block BK0, R-value of the (1,2) pixel P1 of the (1,1) row RW0 of the (1,1) block BK0, . . . , and R-value of the (1,4) pixel P3 of the (1,1) row RW0 of the (1,2) block BK1. The sub-sequence 420 are for B-values and the sub-sequence 430 are for G-values. The sub-sequence 410 is stored in a Bram_R 535. The sub-sequence 420 is stored in a Bram_G 536. The sub-sequence 430 is stored in a Bram_B 537.

Because the current datasets and the previous datasets of the (2,2) block BK3 of the (1,1) area AR0 are identical, the current datasets of the (2,2) block BK3 of the (1,1) area AR0 will not be coded and transmitted, and therefore will not be received by the receiving module. Consequently, the gamma-corrected R-value of the current datasets of the (1,1) pixel P0 to the (1,4) pixel P3 of the (1,1) row RW0 of the (2,1) block BK2 of the (1,1) area AR0 are laminated with the gamma-corrected R-value of the previous datasets of the (1,1) pixels P0 to the (1,4) pixels P3 of the (1,1) row RW0 of the (2,2) block BK2 of the (1,1) area AR0 as a controlling sequence 400, e.g., the (1,1)_(4,1) controlling sequence 400 for controlling the (4,1) LED row LR3 of the (1,1) LED area LAR0.

In addition, since the current datasets and the previous datasets of the (1,2), (2,1) and (2,2) areas AR1 to AR3 are identical, the (1,2), (2,1) and (2,2) LED areas AR1 to AR3 can display the previous datasets.

The driving module 540 is signally connected to the receiving module 530. The driving module 540 includes (1,1) to (N,M) LED controlling sets to control the (1,1) to (N,M) LED areas, respectively, and each of the (1,1) to (N,M) LED controlling sets includes a PWM controller 542 and a decoder 543.

As shown in FIGS. 2, (1,1) to (2,2) LED controlling sets CN0 to CN3 are used to control the (1,1) to (2,2) LED areas LAR0 to LAR3, respectively. Each of the (1,1) to (2,2) LED controlling sets LAR0 to LAR3 includes a local memory 541 to store the PWM duty ratios of the current datasets from the receiving module 530. Once the PWM duty datasets are written to the local memory 541, the (1,1) to (2,2) LED areas LAR0 to LAR3 can continuously display by local control from the stored PWM duty ratios by self-scanning independently.

Precisely, in order to increase the update rate, improve the system stability and reduce the components of the LED panel 200, data transmission and frame scanning are conducted simultaneously with VGA signal, by laminating area address with datasets (previous datasets and current datasets), each of the (1,1) to (2,2) LED areas LAR0 to LAR3 can judge whether the datasets is belong thereto and store the datasets into the local memory 541. Hence, the datasets of the frame is stored in the local memory 541 as the datasets are transmitted to each of the (1,1) to (2,2) LED areas LAR0 to LAR3, and even if the transmission cable is removed, the frame stored previously can still be displayed. In other words, even though a specific row is lit up at a specific scanning time, the other rows of each of the (1,1) to (2,2) LED areas LAR0 to LAR3 will not stop displaying; instead, the other rows will still be lit up by the datasets in the local memory 541 which stores the previous datasets of the previous frame until the current datasets of the current frame are completely received, and then the current frame will be displayed. Hence, after completely receiving the previous datasets of the previous frame, each of the (1,1) to (2,2) LED areas LAR0 to LAR3 will scan and update itself, and even if the size of the LED area in other embodiments is increased, the technique can still be used. However, in a conventional technique, only a specific row is lit up at a specific scanning time while the other rows are dark, and high update rate is required. Therefore, compared to the conventional technique, lower update rate can be used in the present disclosure, and the system stability thereof is increased.

In the LED panel controlling method 100, the current datasets of the (n,m) area are transmitted only when the current datasets thereof are different from the previous datasets thereof. Hence, whether the (1,1) to (N,M) areas of the current frame belonging to still or motion can be detected. If it is motion, the present datasets are transmitted to the LED area for refreshing display; otherwise, the process is skipped. The present datasets can be sent to the relative LED area with the area address through SPI. Since the still LED area will accumulate the errors during a period of time, all of the LED areas are forced to refresh per one second.

In the controlling step S05, the (1,1)_(1,1) controlling sequence is sent to control the (1,1) LED row LRW0. For gray level control, a time stay control for MSB to LSB with various clock periods is used. First, the MSB of the PWM duty ratios of the (1,1) LED row LRW0 with staying 4096 clocks are sent. A 4 to 1 MUX (not shown) selects 4096 and compares a counter (not shown). The counter is counting from 0 to 4096 per cycle. When its counting value arrived at 4096, the counting value resets to zero. At the same time, a pulse is sent to the decoder 552, and the decoder 552 can be a 4-to-16 decoder. The decoder 542 changes the active line from the (1,1) LED row LRW0 to the (2,1) LED row LRW1. All MSB of PWM duty ratios for the (1,1) to (6,1) LED rows LRW0 to LRW5 can be sent. After that, the 4 to 1 MUX selects 2048 for the 2nd MSB control, and then 1024 can be selected. Following this schedule, the LSB is controlled with 512 clocks for scanning the (1,1) to (6,1) LED rows LRW0 to LRW5. After all PWM duty ratios are scanned completely, it is repeated to read the PWM duty ratios from the local memory 541 and scan the PWM duty ratios to the LED panel 200 again without the need of waiting the datasets from the transmitting module 520. Therefore, high brightness for LED display with local scanning can be completed, and the clock frequency of the transmitter does not require very high speed.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. An LED panel controlling method, which is applied to control an LED panel comprising (1,1) to (N,M) LED areas to display a previous frame and a current frame displayed subsequently to the previous frame, each of the (1,1) to (N,M) LED areas comprising (1,1) to (H,1) LED rows, each of the (1,1) to (H,1) LED rows comprising (1,1) to (1,D) LED pixels, the LED panel controlling method comprising:

a frame splitting step, wherein each of the previous frame and the current frame is split into (1,1) to (N,M) areas, each of the (1,1) to (N,M) areas comprises (1,1) to (G,K) blocks, each of the (1,1) to (G,K) blocks comprises (1,1) to (P,1) rows, and each of the (1,1) to (P,1) rows comprises (1,1) to (1,E) pixels, wherein N, M, H, D, G, K, P and E are positive integers, G×P=H, and K×E=D;

a comparing and transmitting step, wherein a plurality of previous datasets of the previous frame are stored in a transmitting module before a plurality of current datasets of the current frames are transmitted to and stored in the transmitting module, the current datasets are compared to the previous datasets, wherein:

whether the current dataset of the (1,e) pixel of the (p,1) row of the (g,k) block of the (n,m) area is different from the previous dataset of the (1,e) pixel of the (p,1) row of the (g,k) block of the (n,m) area is judged, and, if yes, an area address of the (n,m) area, a block address of the (g,k) block, a row address of the (p,1) row, and the current datasets of the (1,1) to (1,E) pixels of the (p,1) row of the (g,k) block of the (n,m) area are coded and transmitted to a receiving module, wherein each of e, p, g, k, n and m represents a variable, e is a positive integer between 1 to E inclusive, p is a positive integer between 1 to P inclusive, g is a positive integer between 1 to G inclusive, k is a positive integer between 1 to K inclusive, n is a positive integer between 1 to N inclusive, and m is a positive integer between 1 to M inclusive; and as long as the current datasets of the (g,k) block of the (n,m) area are identical to the previous datasets of the (g,k) block of the (n,m) area, the current datasets of the (g,k) block of the (n,m) area are not coded and transmitted;

a laminating step, wherein the current datasets of the (p,1) row of one or more of the (g,1) to (g,K) blocks of the (n,m) area newly received by the receiving module are laminated with the previous datasets of the (p,1) row of the rest of the (g,1) to (g,K) blocks of the (n,m) area previously stored in the receiving module to form a (n,m)_((g-1)×P+p,1) controlling sequence; and a controlling step, wherein the (n,m)_((g-1)×P+p,1) controlling sequence is received by a driving module to drive the ((g-1)×P+p,1) LED row of the (n,m) LED area.

2. The LED panel controlling method of claim 1, further comprising:

a signal converting step, wherein a HDMI is converted to a DVI as transmitting the previous datasets of the previous frame or the current datasets of the current frame to the transmitting module.

3. The LED panel controlling method of claim 1, wherein, in the laminating step, an R-value, a G-value and a B-value of each of the current datasets newly received by the receiving module are gamma corrected, respectively, and an R-value, a G-value and a B-value of each of the previous datasets previously stored in the receiving module have already been gamma corrected, respectively.

4. An LED panel controlling system, comprising:

an LED panel configured to display a previous frame and a current frame displayed subsequently to the previous frame, wherein the LED panel comprises (1,1) to (N,M) LED areas, each of the (1,1) to (N,M) LED areas comprises (1,1) to (H,1) LED rows, and each of the (1,1) to (H,1) LED rows comprises (1,1) to (1,D) LED pixels, wherein N, M, H and D are positive integers;

a frame source module configured to provide the previous frame and the current frame, wherein each of the previous frame and the current frame is split into (1,1) to (N,M) areas, each of the (1,1) to (N,M) areas comprises (1,1) to (G,K) blocks, each of the (1,1) to (G,K) blocks comprises (1,1) to (P,1) rows, and each of the (1,1) to (P,1) rows comprises (1,1) to (1,E) pixels, wherein D, G, K, P and E are positive integers, G×P=H, and K×E=D;

a transmitting module configured to receive the previous frame and the current frame, the transmitting module comprising:

a first memorizing set configured to store a plurality of previous datasets of the previous frame;

a second memorizing set configured to store a plurality of current datasets of the current frame;

a comparing module configured to compare the current datasets and the previous datasets; and a coding and transmitting set, wherein:

when the current dataset of the (1,e) pixel of the (p,1) row of the (g,k) block of the (n,m) area is different from the previous dataset of the (1,e) pixel of the (p,1) row of the (g,k) block of the (n,m) area, an area address of the (n,m) area, a block address of the (g,k) block, a row address of the (p,1) row, and the current datasets of the (1,1) to (1,E) pixels of the (p,1) row of the (g,k) block of the (n,m) area are coded and transmitted by the coding and transmitting set, wherein each of e, p, g, k, n and m represents a variable, e is a positive integer between 1 to E inclusive, p is a positive integer between 1 to P inclusive, g is a positive integer between 1 to G inclusive, k is a positive integer between 1 to K inclusive, n is a positive integer between 1 to N inclusive, and m is a positive integer between 1 to M inclusive; and as long as the current datasets of the (g,k) block of the (n,m) area are identical to the previous datasets of the (g,k) block of the (n,m) area, the current datasets of the (g,k) block of the (n,m) area are not coded and transmitted;

a receiving module configured to laminate the current datasets of the (p,1) row of one or more of the (g,1) to (g,K) blocks of the (n,m) area newly received by the receiving module with the previous datasets of the (p,1) row of the rest of the (g,1) to (g,K) blocks of the (n,m) area previously stored in the receiving module to form a (n,m)_((g-1)×P+p,1) controlling sequence; and a driving module, comprising (1,1) to (N,M) LED controlling sets to control the (1,1) to (N,M) LED areas, respectively, and the ((g-1)×P+p,1) LED row of the (n,m) LED area is driven by the (n,m) LED controlling set according to the (n,m)_((g-1)×P+p,1) controlling sequence.

5. The LED panel controlling system of claim 4, wherein the receiving module comprises:

a data reading set configured to read the current datasets, the area address of the (n,m) area, the block address of the (g,k) block and the row address of the (p,1) row newly received;

a gamma correction set configured to correct an R-value, a G-value and a B-value of each of the current datasets newly received; and a data laminating set configured to laminate the R-value, the G-value and the B-value of each of the current datasets that are newly received and gamma corrected with a R-value, a G-value and a B-value of the previous datasets which have already been gamma corrected and are stored in the receiving module.

6. The LED panel controlling system of claim 4, wherein each of the (1,1) to (N,M) LED controlling sets comprises a PWM controller and a decoder.

* * * * *